US005115704A

United States Patent [19]

Hyman

[11] Patent Number: 5,115,704

[45] Date of Patent: May 26, 1992

[54] BREAD CUTTER BOX

[75] Inventor: Herbert B. Hyman, Camarillo, Calif.

[73] Assignee: International Coffee & Tea Inc., Camarillo, Calif.

[21] Appl. No.: 709,168

[22] Filed: Jun. 3, 1991

[51] Int. Cl.[5] ..... B26D 7/20

[52] U.S. Cl. ..... 83/467.1; 83/762; 83/763; 83/764

[58] Field of Search ..... 83/761, 762, 763, 764, 83/765, 823, 829, 870, 454, 455, 467.1, 468.6

[56] References Cited

U.S. PATENT DOCUMENTS

| | | | |
|---|---|---|---|
| 1,867,993 | 7/1932 | Tuttle | 83/762 |
| 2,043,175 | 6/1936 | Johnson | 83/761 |
| 2,352,125 | 6/1944 | Sager | 83/762 |
| 4,085,642 | 4/1978 | Birmingham | 83/764 |
| 4,632,159 | 12/1986 | Glasgo | 83/761 |
| 4,964,323 | 10/1990 | Fortney | 83/764 |

*Primary Examiner*—Douglas D. Watts
*Assistant Examiner*—Allan M. Schrock
*Attorney, Agent, or Firm*—Harris, Kern, Wallen & Tinsley

[57] ABSTRACT

A cutter box for receiving a loaf of bread or the like and guiding slicing of the loaf, including a base having a bottom, a grill with the base having a rim or edge for positioning the grill in the base above the bottom, and a pair of guide plates, with the grill having a plurality of parallel spaced slots for receiving the guide plates, each of the guide plates having a vertical member with a slot for guiding a knife and positionable in the slots of the grill, and a horizontal member positionable in the guide space for holding guide plates in place with the grill is placed in the base, with guide plates being removable from the grill and insertable in different slots.

1 Claim, 2 Drawing Sheets

BREAD CUTTER BOX

BACKGROUND OF THE INVENTION

This invention relates to arrangements for slicing loaves of bakery goods such as bread, cake and the like. Machines are used at bakeries and at retail stores for slicing a loaf of bread prior to packaging. These types of machines are very satisfactory for their purpose, slicing a complete loaf in one operation. However they are not suitable for home use where it is desired to obtain only one or two slices at a time from a loaf. Special knives for slicing bread are available, but have not been very satisfactory, particularly with softer loaves which require manual stabilizing during the slicing operation.

SUMMARY OF THE INVENTION

It is an object of the present invention to provide a new and improved cutter box for receiving a loaf of bread and guiding the slicing of the bread producing one slice at a time. A further object of the invention is to provide such a cutter box which is easily adjustable for handling various widths of loaves and which is readily assembled and disassembled for cleaning and for storage in a flat configuration.

These and other objects, advantages, features and results will more fully appear in the course of the following description.

The presently preferred embodiment of the cutter box includes a base having a bottom, a grill, with the base having means for positioning the grill in the base above the bottom defining a guide space between grill and bottom, and a pair of guide plates, with the grill having a plurality of parallel spaced slots for receiving guide plates, with each of the guide plates having a vertical member with a slot for guiding a knife and positionable in slots of the grill, and a horizontal member positionable in the guide space for holding the guide plates in place when the grill is placed in the base, with the guide plates being removable from the grill and insertable in a different slot.

DESCRIPTION OF THE PREFERRED EMBODIMENTS

Figure 1:
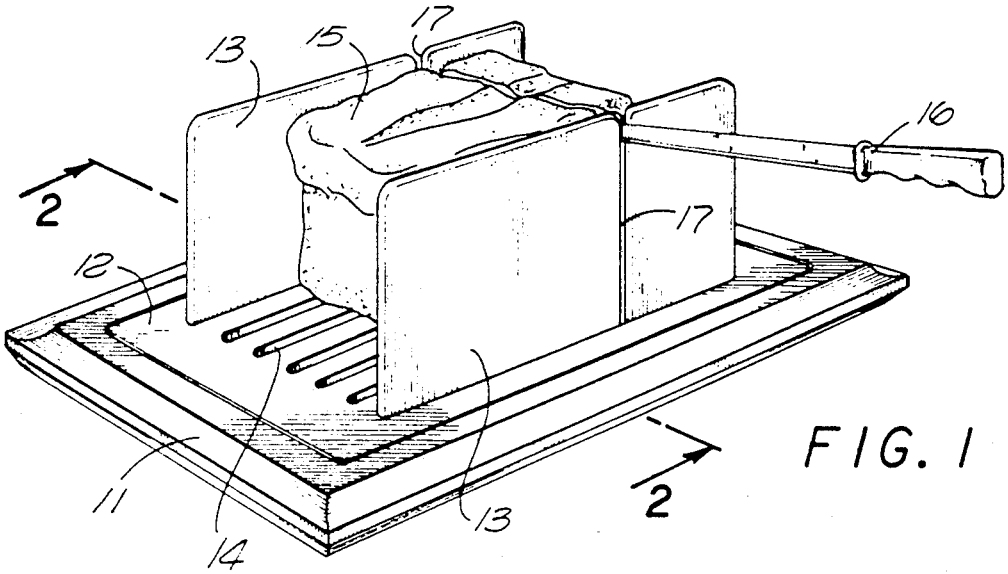
FIG. 1 is a perspective view illustrating the presently preferred embodiment of the cutter box with a loaf of bread being sliced therein.

The cutter box as shown in the drawing figures includes a base 11, a grill 12, and guide plates 13. The grill 12 is positioned in the base 11 and has a group of parallel spaced slots 14 with the guide plates 13 projecting upward though the slots. A loaf 15 is positioned between two of the guide plates 13, and a knife 16 is positioned at vertical slots 17 in the guide plates for making a vertical cut through the loaf.

Figure 3:
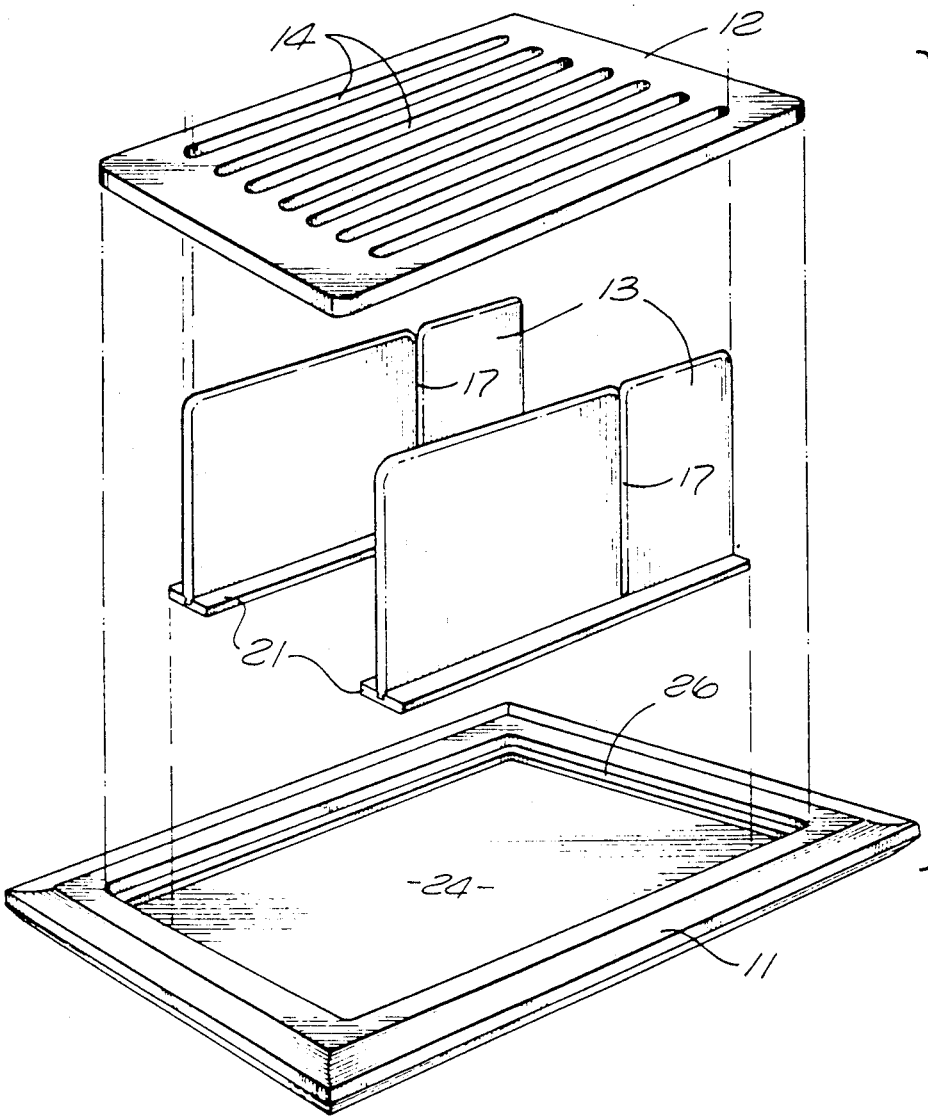
FIG. 3 is an exploded view of the cutter box of FIG. 1.

Each of the guide plates 13 includes a vertical member 20 and a horizontal member 21, with the members joined together. In the embodiment illustrated, the members are made of wood and joined by a dovetail tongue and groove. Alternative constructions may be used, and the guide plate could be molded as a single piece by plastic molding. The bottom 25 of the base may be closed as shown in FIG. 3 and can function as a collector for crumbs. In an alternative arrangement, the bottom may be open, permitting crumbs to fall through.

Figure 2:
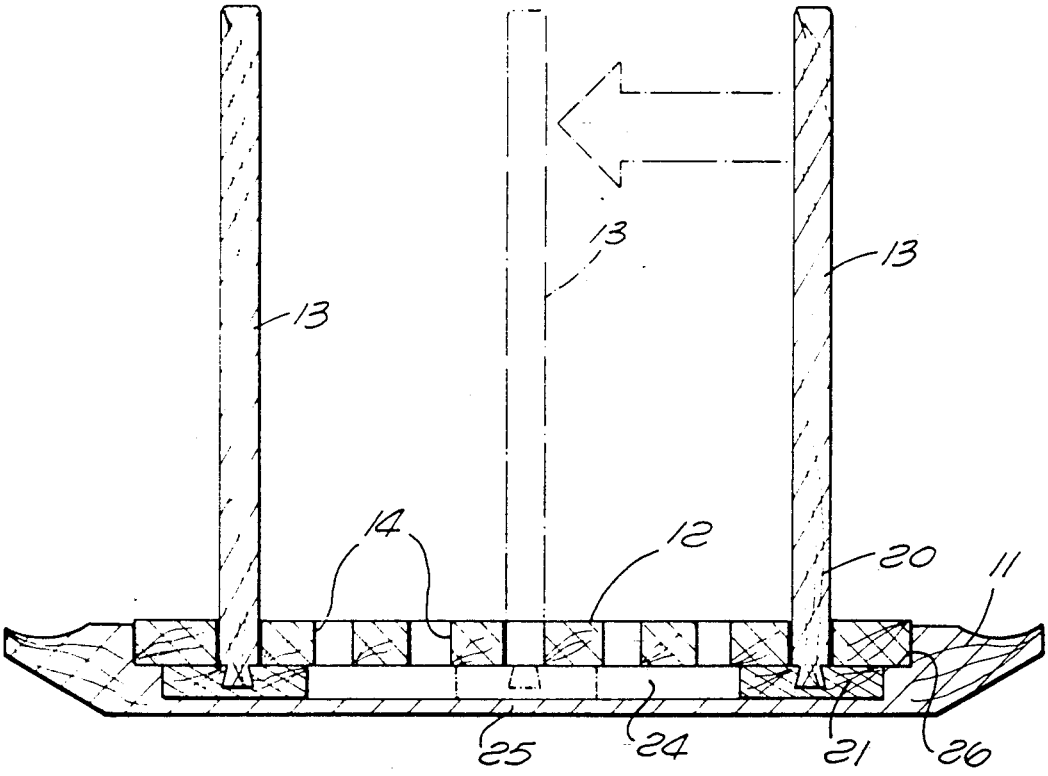
FIG. 2 is an enlarged sectional view taken along the line 2—2 of FIG. 1.
Figure 4:
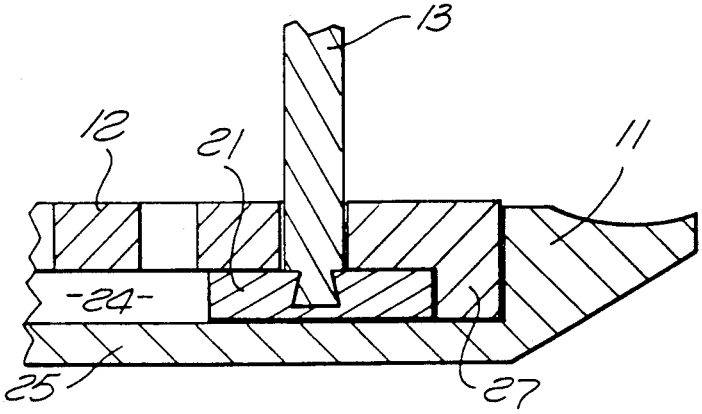
FIG. 4 is a sectional view similar to that of FIG. 2 showing an alternative embodiment of the cutter box.

The grill 12 is positioned in the base 11, with a guide space 24 between the grill and the bottom 25 of the base. In the embodiment illustrated in FIG. 2, the grill rest on a rim 26 of the base. In the embodiment of FIG. 4, the grill 12 has a downturned edge 27 which spaces the grill above the bottom of the base to provide the guide space 24.

In use, the grill is removed from the base and the guide plates are positioned upward through the slots of the grill with the desired spacing between the guide plates. Then the grill with guide plates is positioned in the base. The cutter box is now ready for use in the manner illustrated in FIG. 1. The horizontal members 21 of the guide plates are positioned in the guide space 24. The vertical members of the guide plates can be positioned in any of the slots of the grill, with a second guide plate spacing shown in phantom lines in FIG. 2. After the desired number of slices have been produced, the cutter box may be disassembled by lifting the grill upward and removing the guide plates. The guide plates may be turned 90° so that the vertical members are now horizontal and the cutter box can be stored in a relatively small space.

I claim:

1. In a cutter box for receiving a loaf of bread or the like and guiding slicing of the loaf, the combination of:

a base having a planar top and a closed bottom;

a grill, said base having means defining a grill receiving opening in said top for positioning said grill within said opening in said base and a guide space between said grill and said bottom and defining a rim of said planar top around and substantially flush with said grill, with said base supporting said grill and with said rim of said base limiting lateral movement of said grill and providing a planar work surface substantially flush with and around said grill; and a pair of guide plates, said grill having a plurality of parallel spaced slots for receiving said guide plates, each of said guide plates having a vertical member with a slot for guiding a knife and positionable in said slots of said grill, and a horizontal member positionable in said guide space for holding said guide plates in place when said grill is placed in said base, with said guide plates being removable from said grill and insertable in a different slot when said grill is separate from said base.

* * * * *